US006550996B1

(12) United States Patent
Rayfield

(10) Patent No.: US 6,550,996 B1
(45) Date of Patent: Apr. 22, 2003

(54) LOTION AND BATH HANDLER

(76) Inventor: Reginald R. Rayfield, 27 Greenwood Ave., Darien, CT (US) 06820

( * ) Notice: Subject to any disclaimer, the term of this patent is extended or adjusted under 35 U.S.C. 154(b) by 0 days.

(21) Appl. No.: 10/078,878

(22) Filed: Feb. 19, 2002

(51) Int. Cl.[7] ..... A45D 34/00
(52) U.S. Cl. ..... 401/6; 401/206
(58) Field of Search ..... 401/6, 206, 205

(56) References Cited

U.S. PATENT DOCUMENTS

| | | | | |
|---|---|---|---|---|
| 2,829,393 A | | 4/1958 | Turcotte | |
| 2,864,367 A | | 12/1958 | Mende | |
| 4,861,180 A | * | 8/1989 | Adams | 401/6 X |
| 5,851,077 A | * | 12/1998 | Trejo | 401/6 |
| 6,017,162 A | | 1/2000 | Call | |
| 6,247,862 B1 | * | 6/2001 | Garza | 401/6 |

OTHER PUBLICATIONS

Solutions Catalog, Jan. 2002, p. 44.

* cited by examiner

*Primary Examiner*—Gregory L. Huson
*Assistant Examiner*—Kathleen J. Prunner
(74) *Attorney, Agent, or Firm*—Fattibene & Fattibene; Paul A. Fattibene; Arthur T. Fattibene

(57) ABSTRACT

A lotion or soap handler has either a fixed or telescoping elongated tubular handle which defines a reservoir in which a supply of lotion or soap is readily stored. A porous foam or sponge applicator is connected to the handle and a valving mechanism is provided in the handle between the reservoir and the applicator for incrementally controlling the flow of soap or lotion from the handle to the applicator. The valve mechanism is operated by a push button mounted on the handle adjacent the gripping portion. A cover is provided to protect the applicator when not in use.

11 Claims, 4 Drawing Sheets

LOTION AND BATH HANDLER

FIELD OF THE INVENTION

This invention relates to a type of applicating device, and more specifically to a lotion and bath handler capable of applying lotion, soap and the like, to parts of a body not normally accessible by one's own hands.

BACKGROUND OF THE INVENTION

It has been noted that considerable difficulty has been encountered when one seeks to apply a lotion, soap, or other liquid type medication to one's back or other parts of one's body not readily accessible by one's hands. This problem is compounded if the person suffers with some form of disability such as arthritis, bursitis, obesity or other disability which limits one's range of motion. This problem is also apparent when one bathes or showers, as it is difficult, if not impossible, for one to apply a soap or other type of lotion to one's back when showering or bathing. As a result, the soap, lotion or other medication cannot be properly applied to one's back by a person himself for maximum effect.

Some efforts have been made to overcome the problems noted. Back scratchers are known. However, the known back scratchers merely function as a scratching implement to relieve an itch and are incapable of applying a soap, lotion or other comforting fluids to one's back. Other known efforts include U.S. Pat. No. 2,829,393 directed to a cosmetic and lotion applicator that includes a pad of sponge rubber having a limited lotion capacity. U.S. Pat. 2,864,367 is directed to an applicator for directing a flowable fluid into a body cavity. U.S. Pat. 6,017,162 is directed to a lotion dispenser having a roller which is coated with lotion. While the known type applicators and back scratchers may be suitable for their particular intended purposes, they do not function to solve all of the noted problems encountered in applying a soap, liquid or lotion to one's back

SUMMARY OF THE INVENTION

An object of the present invention is to provide a lotion or soap handler constructed to contain a relatively large lotion reservoir having a controlled outlet for dispensing the lotion or soap onto a sponge as needed.

Another object is to provide a lotion handler which is rendered readily adjustable between an extended and retracted position so as to reach all portions of one's body.

Another object is to provide a lotion or soap handler having an applicating end formed of a porous or open cellular material so as to allow the lotion or soap to permeate therethrough in a controlled manner.

The foregoing objects and other features and advantages are attained by a soap or lotion handler having an elongated tubular handle which may be of a fixed predetermined length or a telescoping shaft that is adjustable between a retracted and protracted position. The handle is essentially hollow and sealed at one end thereof by a removable closure to define a reservoir for containing a supply of a lotion, liquid or soap to be dispensed. Connected to the other end of the handle is a rigid support of a predetermined shape for supporting thereon a porous or open cell sponge or foam applicator. Adjacent the applicator, the handle defining the reservoir is provided with a valve means or mechanism which is shifted between an open and closed position by a valve actuator in the form of an actuating button located on the handle. In the event the handle is formed of telescoping shaft portions, an adjusting and holding means is provided to adjust the telescoping handle portions and to fix the telescoping handle portion in the adjusted position. A cover is provided to cover the sponge applicator after the use thereof.

IN THE DRAWINGS

DETAILED DESCRIPTION

Figures 1, 2, 3:
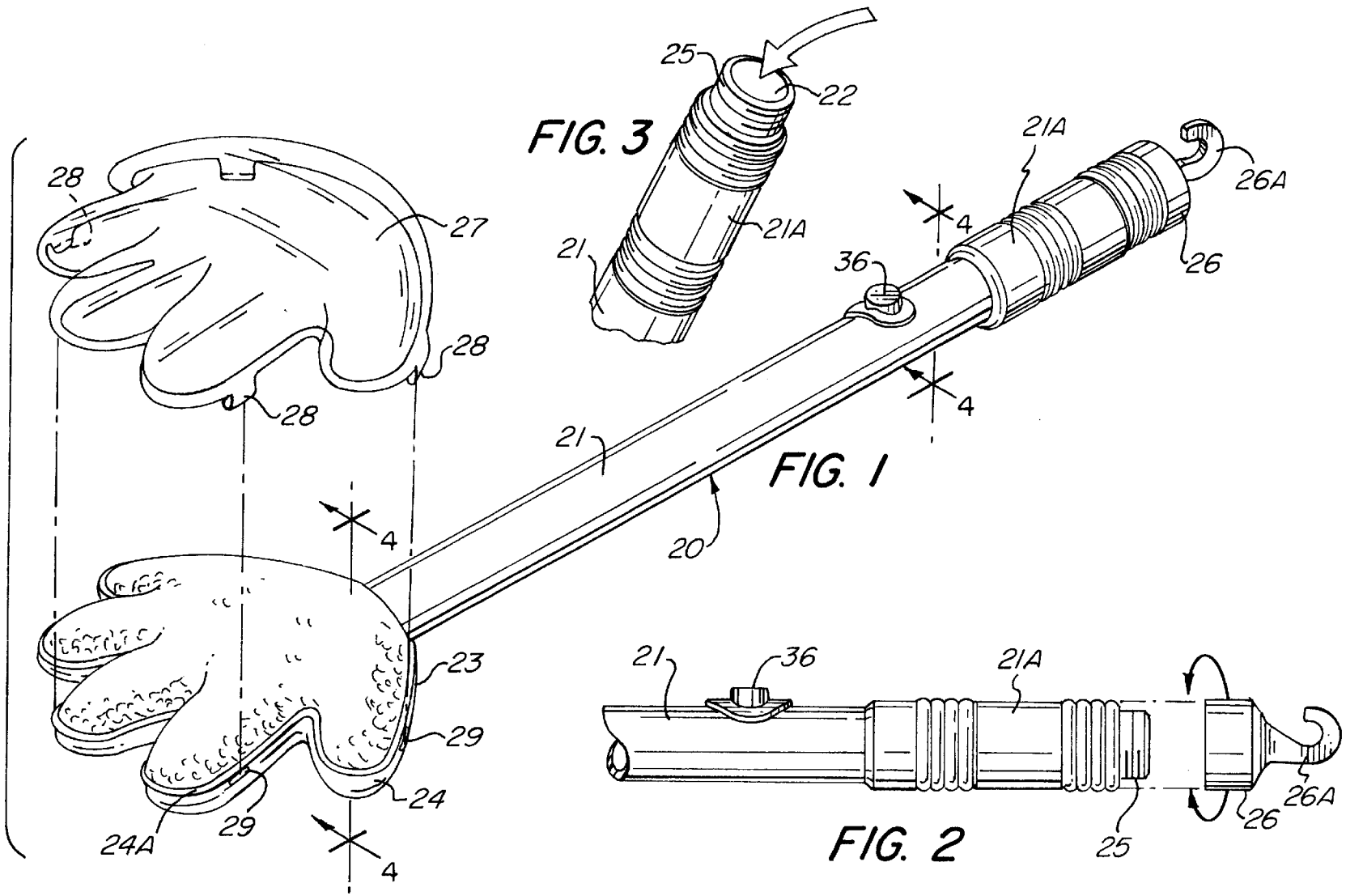
FIG. 1 is an exploded perspective view of one form of the invention.
FIG. 2 is a fragmentary side view of an end portion of FIG. 1.
FIG. 3 is a perspective view of the end portion of the handle.

Referring to the drawings, there is illustrated two embodiments of a lotion and bath handler embodying the present invention. FIGS. 1 to 5 are directed to a first embodiment and FIGS. 6 to 12 illustrated a second embodiment.

Referring to the embodiment of FIGS. 1 to 5, there is shown a lotion and bath handler 20 that includes a handle 21 that is formed of a hollow tube which is open at one end 22, and a foam, porous rubber or sponge applicator 23. The foam or sponge applicator 23 has a porous or open cell structure so as to allow the liquid ingredient, e.g., soap, lotion or other fluid material to permeate therethrough as will be herein described.

Connected to the front end of the handle 21 is a rigid support or plate 24 to support the sponge applicator 23 disposed thereon. In the illustrated embodiment, the applicator 23 and its support 24 are configured in the form of a human hand. However, it will be understood that the shape of the applicator 23 and the support 24 may be configured to simulate other shapes. As it is shown in FIG. 1, the applicator extends above the peripheral edge 24A of the rigid support 24.

The open end 22 defines the inlet opening to the tubular handle 21, which forms a reservoir for containing a predetermined supply of the fluid medium, e.g., liquid soap, lotion, bath oil, suntan lotion and the like which the user wishes to dispense. In the illustrated embodiment, the open end is provided with threads 25 to which an end closure 26 may be threaded to seal the inlet opening and the reservoir. Connected to the end closure 26 is a hook 26A to facilitate storage of the handle 20 when not in use. Also, a protective cover 27 is provided to cover the applicator when not in use.

The cover 27 is shaped to complement the shape of the applicator. Spaced about the periphery of the cover there are provided a series of latches 28 arranged to mate with a series of catches 29 formed on the rigid support. The arrangement is such that the cover 27 can be readily snapped on and off the rigid support.

Figure 4:
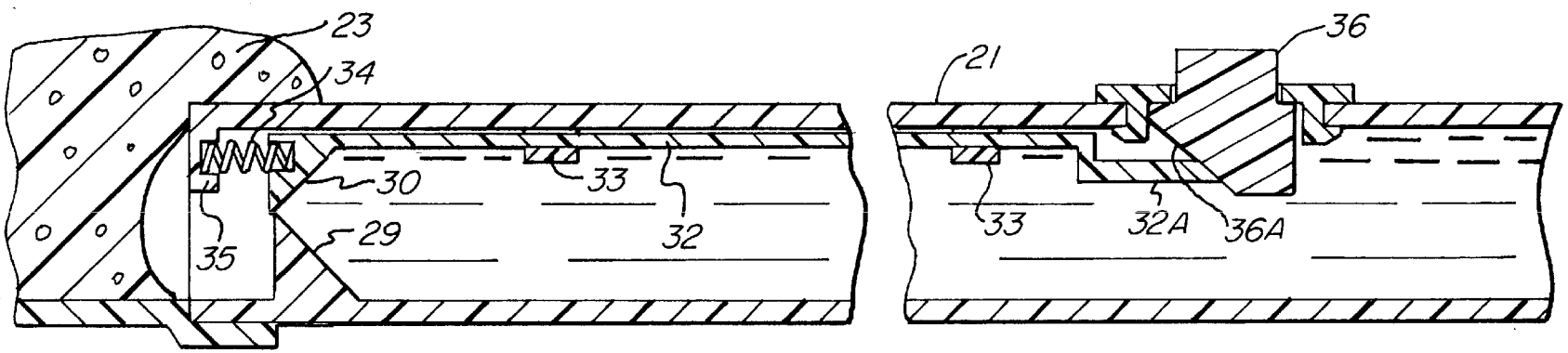
FIG. 4 is a longitudinal sectional view taken along line 4—4 on FIG. 1, showing the valve in the closed position.
Figure 5:
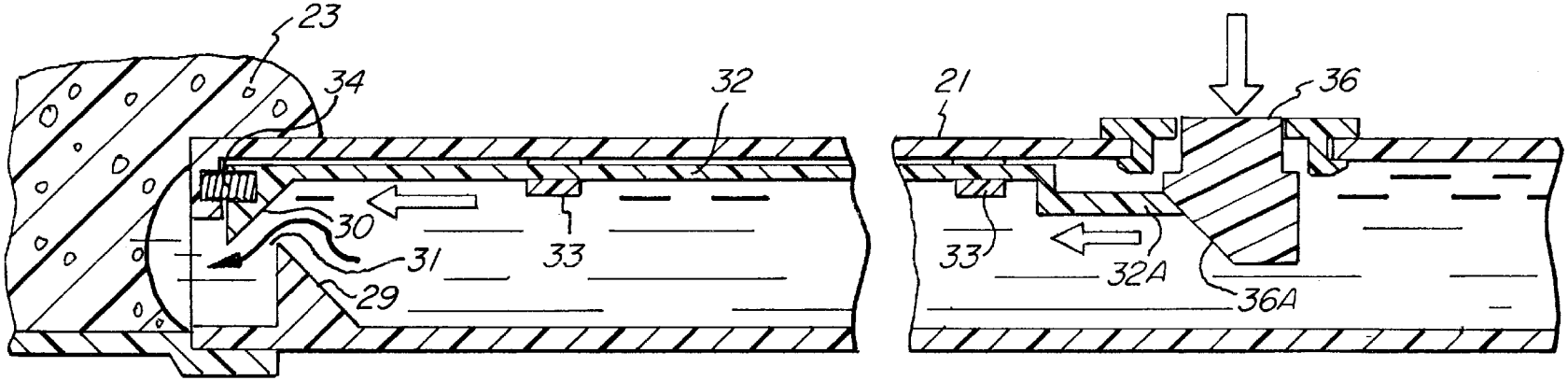
FIG. 5 is a longitudinal sectional view similar to FIG. 4 showing the valve in an open position.

In accordance with this invention, a valve mechanism or means is provided whereby the fluid or lotion disposed in the handle reservoir may be released to flow through the applicator 23 at the will of the user. As best seen in FIGS. 4 and 5, the valve mechanism is disposed between the reservoir and the porous applicator 23 and includes a fixed portion 29 and a movable portion 30 to define an orifice opening 31 when the movable portion 30 is shifted to an open position. The fixed portion 29 may be an integral or stationary part of the internal handle adjacent to the applicator 23. The movable portion 30 is connected to a push bar 32 which is slidably mounted internally of the handle. Suitable guides 33 maintain the push bar 32 in sliding relationship relative to the handle. A spring 34 interposed between the movable portion 30 and an inturned flange 35 normally urges the movable portion to a closed position, as best seen in FIG. 4.

To shift the push bar 32 to an open valve position to dispense the fluid in the reservoir by gravity, a means for actuating the valve means is provided. In the illustrated embodiment of FIG. 1, the means for actuating is a valve actuator in the form of a push button 36 mounted adjacent the gripping portion 21A on the handle 21. The arrangement is such that the button 36 normally projects outwardly of the handle 21 as seen in FIG. 4. The push button 36 is provided with a cam surface 36A disposed in camming relationship with the end 32A of the push bar 32. Thus, when the button 36 is depressed, the cam surface 36A urges the push bar 32 to the left as shown in FIG. 5. When the button 36 is released, the spring 34 urges or biases the push bar 32 to the right as best seen in FIG. 4 to shift the valve 30 to a closed position. In doing so, the button 36 is cammed upwardly to its normal inoperative position as seen in FIG. 4.

To operate, the desired or preferred material or lotion to be dispensed is poured into the tube handle 21 through the inlet 22. When filled, the inlet 22 is sealed by end cap or closure 26. If necessary, the end closure may be vented to atmosphere. To effect fluid flow to the resilient applicator 23, the valve button 36 is depressed to shift valve 30 toward open position, causing the fluid or preferred lotion or soap in the reservoir of handle 21 to flow into the applicator to permeate therethrough. The user can then apply the lotion with a massaging effect to the various body parts desired, whereby the lotion can be replenished at the applicator by the operator, at will, simply by depressing the push button 36. To store the handler 20, the cover 27 is snapped onto the rigid support to seal the applicator 23 therebetween, and the hook 26A provides the means for hanging the handler 20 on a suitable support.

Figures 6, 7, 7A, 8:
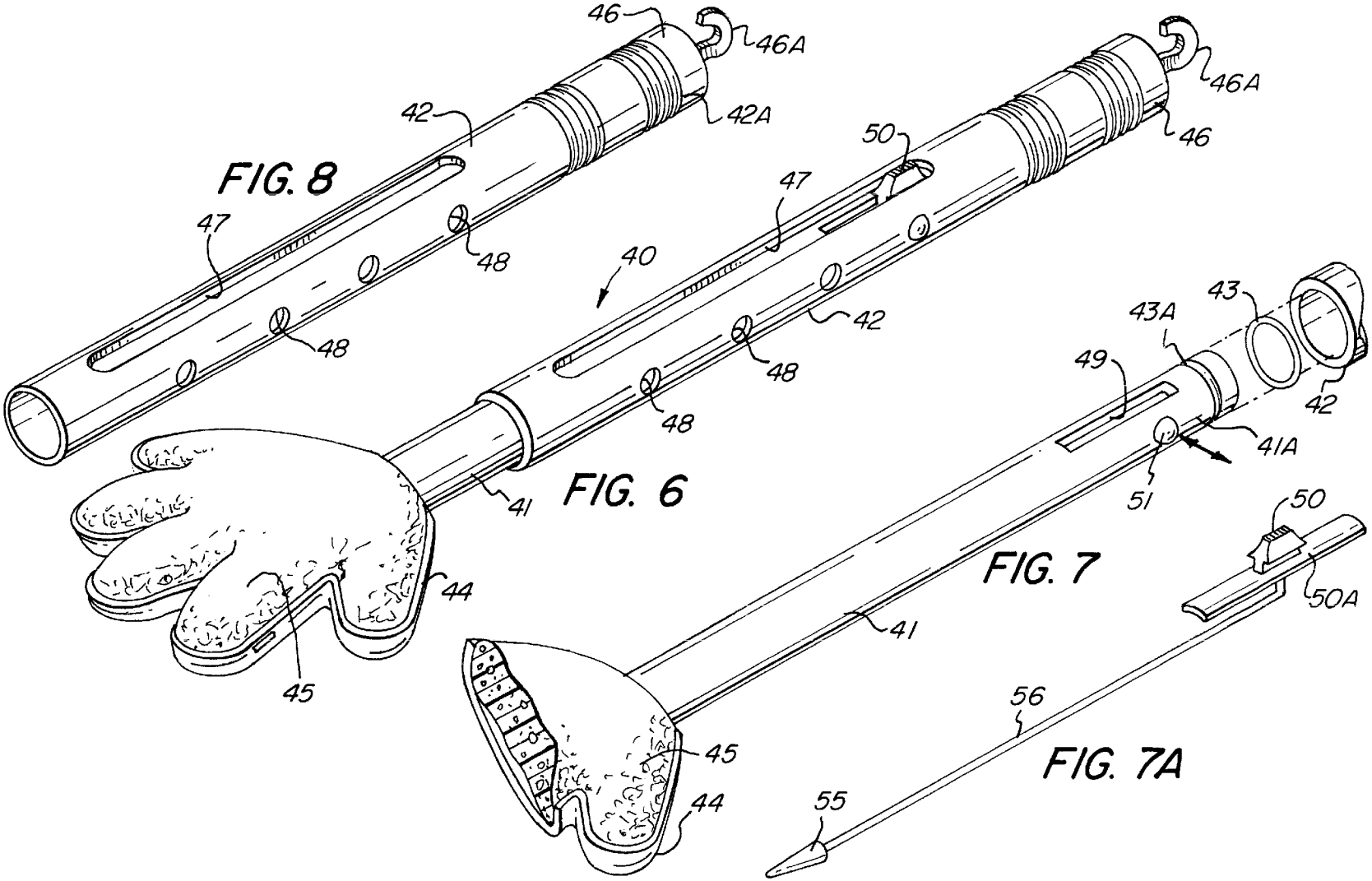
FIG. 6 is a perspective view of a modified form of the invention.
FIG. 7 is a fragmental perspective view of the embodiment of FIG. 6.
FIG. 7A is a perspective view of a detail of construction.
FIG. 8 is a perspective view of a handle portion of FIG. 6.

FIGS. 6 to 12 illustrate another embodiment of the preferred invention. In this embodiment, the handler 40 is provided with a telescoping handle which includes an inner handle member 41 and an outer handle member slidably mounted thereon for moving between a retracted or protracted or extended position. One or more sealing rings 43 may be provided to define a fluid tight seal between the respective sliding members 41 and 42. As best seen in FIG. 7, the sealing ring 43 may comprise an O-ring adapted to seat in an O-ring groove 43A formed on the inner member 41.

Connected to the inner member 41 at the forward end thereof is a rigid support 44 similar to support 24 for supporting thereon an applicator 45 similar to that hereinbefore described.

As best seen in FIG. 8, the outer handle member 42 is provided with an inlet end 42A sealed by an end closure or cap 46, which is provided with a hanging hook 46A. The handle member 42 is also provided with an elongated slot 47 and a series of holes 48 disposed in a row angularly offset relative to slot 47.

The inner handle member 41 has an elongated opening 49 adjacent the inner end 41A thereof, adapted to receive the slide button or valve actuator 50 as will be hereinafter described. The inner member 41 is also provided with a pin opening 51 for receiving an adjusting pin 52. See FIG. 11. The adjusting pin 52 is connected adjacent the end of a flat spring 53 which normally biases the adjusting pin 52 outward through pin opening 51, as best seen by the solid line showing in FIG. 11.

Figure 9:
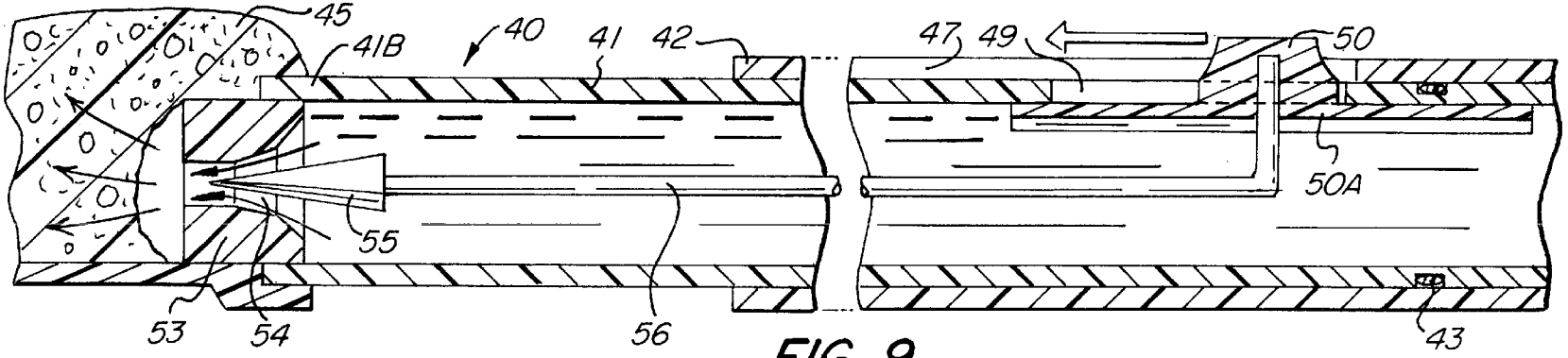
FIG. 9 is a longitudinal section view of the embodiment of FIG. 6.

The forward end 41B of the inner handle member has connected thereto a valve seat 53 having formed therein a needle valve orifice 54. A needle valve 55 is connected to a push rod 56, which in turn is connected to a slide valve actuator 50. The valve actuator 50 is arranged to project upwardly through the elongated opening 49 formed in the inner handle member 41, as best seen in FIG. 9. Referring to FIG. 7A, the valve actuator includes a connected shield 50A of sufficient length to shield or close the elongated slot 49 in either the open or closed position of the valve actuator 50. Referring to FIG. 9, when the valve actuator 50 is in the open valve position, as shown, the forward portion of the shield 50A seals opening 49. When the valve actuator is shifted to the left, as viewed in FIG. 9, to the closed valve position, the rear portion of the shield 50A seals the opening 49.

Figure 11:
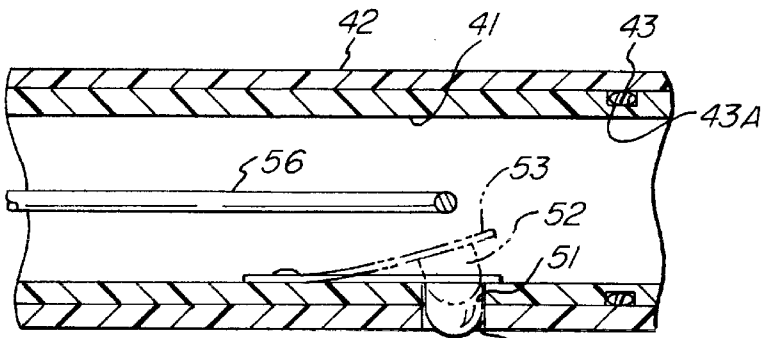
FIG. 11 is a sectional view of a construction detail.

In fitting the outer handle member 42 to the inner handle member 41, the outer member is orientated so that the elongated slot 47 is disposed in alignment with the valve actuator 50 and the row of holes 48 are in alignment with the adjusting pin hole 51 and adjusting pin 52. In this manner, the outer member 42 can be readily extended between an extended or retracted position relative to the inner member 41. To effect adjustment, the adjusting pin is depressed as shown in the phantom line position as shown in FIG. 11, whereby the outer member 42 is rendered free to slide relative to the inner member 41. When the desired hole 48 is brought in alignment with pin opening 51, the adjusting pin 52 is released, permitting the pin 52 to project through the aligned pin opening 51 and the aligned desired pin hole 48, securing the handle members 41 and 42 in the adjusted position. In all other respects, the handler 40 is similar to that described with respect to handler 20.

Figure 10:
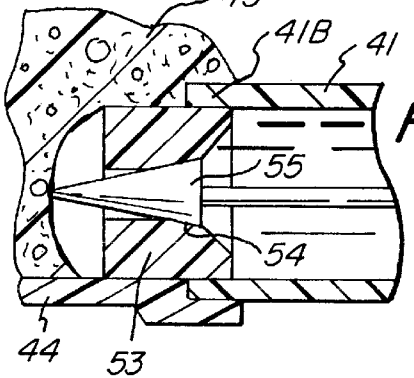
FIG. 10 is a fragmentary sectional view showing the valve of the embodiment of FIG. 6 in a closed position.
Figure 12:
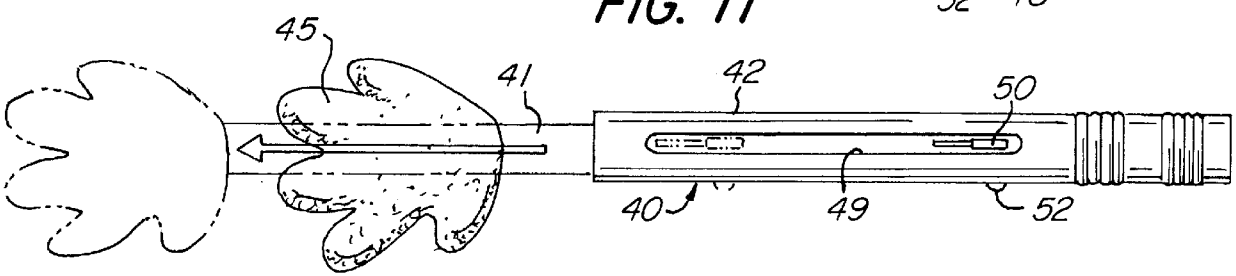
FIG. 12 is a top view of FIG. 6 illustrating the parts in protracted and retracted position.

In operation, the tubular handle 41, 42 is filled with the fluid material to be dispensed through the inlet end 42A, which is sealed by the end closure or cap 46. The handle portion 41, 42 may then be adjusted to the desired length as hereinbefore described. To dispense the fluid material, e.g. liquid soap, to the applicator 45, the valve actuator 50 is moved or slid to a position shown in FIG. 9 wherein the needle valve 55 is withdrawn from the valve seat 53, permitting the fluid to flow through the valve orifice 54 and onto the applicator 45, the fluid material permeating through the open cells of the applicator 45. To close the valve orifice 54, the actuator 50 is shifted in the opposite direction causing the needle valve 55 to close the valve orifice 54, as shown in FIG. 10.

From the foregoing, it will be apparent that the handlers 20 and 40 described provides for a relatively simple arrangement whereby a large supply of a fluid to be dispensed can be readily stored within the handle and from which the fluid can be incrementally released to the applicator. The arrangement can be effected in a handler having either a handle of a fixed length or an adjustable length. In either embodiment, a valve means is provided by which an operator can effect the release of the material from the reservoir to the applicator at will. The applicator is further formed of a permeable porous or open cell foam or sponge, either natural or synthetic, and which surface provides for a comforting massaging effect when used. A cover is also provided for protecting the applicator end when not in use.

While the present invention has been described with respect to a particular embodiment, modifications and variations may be made without departing from the spirit or scope of this invention.

What is claimed is:

1. A lotion handler comprising:

an elongated tubular handle defining a reservoir for containing a predetermined supply of a fluid material to be dispensed;

said tubular handle having an inlet opening to said reservoir;

a closure for sealing said inlet;

a rigid support connected to said handle;

a porous applicator disposed on said support;

a valve means disposed between said reservoir and said porous applicator wherein said valve means controls the flow of fluid from said reservoir to said porous applicator;

and means on said handle for actuating said valve means between an open and closed position.

2. A lotion handler as defined in claim 1 and including:

a cover for said porous applicator;

said cover conforming in size and shape of said porous applicator; and complementary fastening means formed on said cover and said support member for detachably securing said cover to said support.

3. A lotion handler as defined in claim 1 wherein said applicator has a shape simulating a human hand.

4. A lotion handler as defined in claim 1 wherein said tubular handle has a predetermined fixed length.

5. A lotion handler as defined in claim 1 wherein said tubular handle includes inner and outer telescoping members for extending between a retracted and protracted position; and a sealing bearing interposed between said telescoping members.

6. A lotion handler comprising:

a handle;

said handle including a first and second tubular member;

said first and second member disposed in telescoping relationship to extend between a retracted and protracted position;

a sealing bearing interposed between said first and second tubular members;

said first and second members defining a reservoir for containing a predetermined amount of fluid to be dispensed;

one of said tubular members having an inlet opening to said reservoir;

a closure for sealing said inlet;

a rigid support connected to one end of said telescoping tubular members;

a porous cellular applicator disposed on said rigid support;

a valve means interposed between said reservoir and said cellular applicator to control the flow of fluid from said reservoir to said cellular applicator; and means for adjusting and maintaining said first and second members in an adjusted position.

7. A lotion handler as defined in claim 6 and including a cover adapted to be detachably connected to said rigid support to protect said cellular applicator when not in use.

8. A lotion handler as defined in claim 6 wherein said first tubular member defines an inner member and said second tubular member defines an outer member of said telescoping handle;

and said adjusting means including a pin opening formed on said inner member;

an adjusting pin disposed in alignment with said pin opening;

a spring means normally biasing said adjusting pin outwardly of said pin opening;

and said outer member having a series of holes longitudinally spaced along the length thereof and arranged to be disposed in alignment with said pin opening whereby adjustment of said inner and outer members is effected by aligning one of said holes with said pin opening.

9. A lotion handler comprising:

a handle;

said handle including an inner tubular member and an outer tubular member disposed in telescoping relationship to extend between a retracted position and a protracted position;

a sealing ring interposed between said inner and outer members;

said tubular members defining a reservoir for retaining a supply of a fluid material to be dispensed;

said reservoir having a fluid inlet;

a closure for sealing said fluid inlet;

a rigid support connected to one end of said inner tubular member adjacent to said reservoir;

a porous foam applicator disposed on said rigid support for absorbing the fluid being discharged from said reservoir;

a valve means for controlling the flow of fluid from said reservoir;

said valve means including a valve seat having a valve orifice; and a valve for valving said valve orifice;

a valve actuator projecting outwardly of said inner tubular member;

means interconnected between said valve actuator and said valve for rendering said valve responsive to the actuation of said valve actuator; and means for locking said inner and outer tubular members in an adjusted position;

said last mentioned means including a pin opening adjacent one end of said inner tubular member;

a locking pin disposed in alignment with said pin opening;

a spring normally biasing said locking pin outwardly of said pin opening; and said outer tubular member having a series of holes longitudinally spaced along the length thereof whereby adjustment of said inner and outer tubular members is effected by aligning one of said holes with said pin opening so that said locking pin is projected through said aligned pin opening and said one opening to fix the adjusted position;

and a cover for said applicator;

said cover and rigid support having complementary fasteners for detachably securing said cover to said rigid support.

10. A lotion handler as defined in claim 9 and including an elongated opening adjacent one end of said inner tubular member; and said valve actuator including a button projecting outwardly of said elongated opening; and a shield extending forwardly and rearwardly of said button for shielding said elongated opening in either the open or closed position of said valve actuator.

11. A lotion handler as defined in claim 10 wherein said outer tubular member has an elongated slot disposed in alignment with said valve actuator.

* * * * *